United States Patent [19]

Mayer

[11] Patent Number: 4,682,531

[45] Date of Patent: Jul. 28, 1987

[54] APPARATUS AND METHOD FOR REGULATING THE RATE OF CHANGE OF FLOW OF A FLUIDIZED MEDIUM

[75] Inventor: John D. Mayer, King County, Wash.

[73] Assignee: The Boeing Company, Seattle, Wash.

[21] Appl. No.: 815,369

[22] Filed: Dec. 31, 1985

[51] Int. Cl.[4] ..... F15B 11/08; F15B 13/04

[52] U.S. Cl. ..... 91/446; 91/448; 91/468; 137/514.5; 251/51; 251/52

[58] Field of Search ..... 91/446, 447, 448, 468; 137/514.5; 251/51, 52

[56] References Cited

U.S. PATENT DOCUMENTS

| | | | |
|---|---|---|---|
| 2,659,384 | 11/1953 | Lowe | 251/52 |
| 3,107,688 | 10/1963 | Caslow | 137/514.5 X |
| 3,605,802 | 9/1971 | Hertell | 137/514.5 |
| 3,735,777 | 5/1973 | Katzer et al. | 137/514.5 |

*Primary Examiner*—Allen M. Ostrager
*Attorney, Agent, or Firm*—Hughes & Cassidy

[57] ABSTRACT

A control valve for limiting the flow rate of a fluidized medium to a hydraulic motor during start up of the motor so as not to induce loads which exceed predetermined torque limits of apparatus driven by the motor. The control valve includes a poppet which is spring biased to a seated closed position. Increasing inlet-to-outlet pressure differential unseats the poppet in a downstream direction uncovering bypass ports which allow an initial surge of fluid to the motor to accelerate the motor to a predetermined speed at a rate which does not exceed the torque limits. Further downstream movement of the poppet exposes greater cross-sectional areas of main inlet ports which permit additional modulated fluid flow to accelerate the motor to its operational speed. The rate of movement of the poppet in the downstream direction is limited by flow restrictor orifices which conduct fluid which is displaced from a chamber due to the downstream movement of the poppet. Rapid resetting of the poppet is effected by the spring bias in conjunction with the return flow of fluid into the chamber via a path which bypasses the flow restrictor orifices.

17 Claims, 7 Drawing Figures

APPARATUS AND METHOD FOR REGULATING THE RATE OF CHANGE OF FLOW OF A FLUIDIZED MEDIUM

TECHNICAL FIELD

The present invention relates to apparatus and methods for controlling the rate of change of flow of a fluidized medium during start up of a hydraulic motor or actuator, and more particularly to apparatus and methods for controlling the rate of change of flow of the fluidized medium during a period when the fluidized medium is initially directed to the hydraulic motor or actuator in order to reduce the start up acceleration rate of the motor.

BACKGROUND OF THE INVENTION

Jet transport aircraft commonly include a number of flap devices attached to the trailing edges and/or leading edges of each wing of the aircraft. In some aircraft, such as the Boeing 767, the trailing edge flaps are extended and retracted by means of rotary actuators which are mounted to the wing. Each of the rotary actuators includes an actuating arm interconnected with flap linkage that in turn is connected to the flap itself. Rotation of the actuating arm drives the interconnecting flap linkage to extend and retract the flap. The wing has a common drive shaft which is connected to each of the rotary actuators. When an aircrew member moves a flap handle in the cockpit to change the position of the flaps, fluid is directed to a hydraulic motor causing rotation of the common drive shaft and a subsequent change in flap position. The flap motor is designed to develop sufficient torque to drive all of the actuators simultaneously via the common drive shaft. It is generally known however, that hydraulic motors have a very rapid start up rate if the hydraulic flow is not modulated, some accelerating from zero rpm to thousands of rpm in less than a second. This rapid start up rate is opposed by inertial loads, as well as viscous drag loads due to grease in the actuator and linkage bearings, that add to the normal design loads applied to the rotary actuators and flap linkage. In some flap systems these loads are prevented from being transmitted to the actuator by a torque limiter installed in each of the actuators. The torque limiter limits the amount of torque which can be applied from the drive shaft to the actuator. However, the added inertia and viscous drag loads resulting from rapid start up sometimes can result in unwanted actuation of these torque limiters causing lock up of the rotary actuators and preventing further movement of the flaps.

The following patents disclose various apparatus utilized to regulate the flow of a fluidized medium. U.S. Pat. No. 3,001,799—by Plume, discloses an airflow control valve for regulating the flow of air to a vehicle airspring. The airflow control valve includes a spring biased valve member having an axial bypass passageway for directing the flow of air to meet transient airflow demands when the valve member remains seated; the valve member unseating against the bias of the spring during periods of higher airflow demand to uncover a main passageway to meet the higher airflow demand.

A valve for controlling the flow of hydraulic fluid in two directions is disclosed in U.S. Pat. No. 3,093,155—by Dawes, wherein the flow rate is controlled by the position of an axially variable sleeve which is manually positioned at selected axial locations to permit a predetermined flow rate in opposite axial directions, and which may be released from engagement so that the variable sleeve position is controlled by the bias pressure of a spring member.

Hertell, U.S. Pat. No. 3,605,802, discloses a check valve having a spring biased valve member which unseats when incoming hydraulic pressure is sufficient to overcome the spring bias, and wherein movement of the valve member in the open direction is dampened by the displacement of hydraulic fluid.

In U.S. Pat. No. 3,468,341—by Newcomb et al, discloses a valve for precisely controlling vacuum; the valve including a valve member which is moved axially by movement of a diaphram so that a plurality of valve slots are opened to provide progressively increasing cross sectional areas thereby gradually increasing communication of the vacuum through the valve.

Alexander, U.S. Pat. No. 3,621,875, discloses a pressure actuated valve including a poppet member which is biased to a closed position by means of communicating first and a second axially disposed springs in which the first spring is disposed within a hydraulic dashpot to dampen compression of the spring in response to low frequency, longer duration poppet movement, and in which the second spring is undampened and responsive to high frequency, short duration poppet movement.

A control valve for providing a constant volume output in response to varying input pressures is disclosed by Olsson in U.S. Pat. No. 3,809,111, wherein a biased poppet valve is movable axially so that when the poppet is moved in a direction which compresses a spring, flow channels are opened which allow fluid to bypass the poppet valve to a location rearward of the poppet thereby reducing the pressure differential at opposite ends of the poppet to counteract the increased bias resistance of the compressing spring.

In U.S. Pat. No. 3,850,195—by Olsson, there is disclosed a control valve including a valve member repositionable axially within a housing bore by fluid pressure exerted against a spring bias, so that movement of the valve member against the spring bias progressively closes off peripheral passageways utilized for directing the hydraulic fluid around the valve, until all flow of fluid is halted.

In Dubell, U.S. Pat. No. 4,157,012 there is disclosed valve means to prevent pressure perturbations from occurring in a fuel delivery system for a gas turbine engine, wherein the valve means includes a poppet spring biased to a closed position and having an axial passageway in communication with the valve inlet and outlet for conducting small volumes of fluid therethrough when the poppet is closed to maintain a predetermined pressure differential; the valve means including bypass passageways which are opened when the pressure differential across the poppet is sufficient to move the poppet axially against the bias of the spring.

An engine exhaust muffler is disclosed by Dolejsi in U.S. Pat. No. 4,161,996, including a cylindrical member having a valve body which is slidably guided within the cylinder for axial movement so that a number of radially outlet openings are successively covered or uncovered by movement of the valve body to obtain a substantially constant pressure drop across the muffler which is independent of outlet flow.

U.S. Pat. No. 4,350,199—by Bunn et al, discloses a valve assembly including a poppet which is spring biased into a seated closed position, the face of the poppet having grooved portions which receive inlet fluid therein to lower the pressure differential required to open the poppet.

SUMMARY OF THE INVENTION

The present invention pertains to a flow control valve for a hydraulic system, preferably one used to control an aircraft mechanically driven trailing edge flap system. It is known that if hydraulic flow is not modulated, hydraulic motors have high rates of acceleration during initial start up from a stationary condition. These high start up acceleration rates can sometimes induce loads which can exceed predetermined torque limits established for components of the flap system. In order to remain within these predetermined torque limits, it is desirable to control the start up rate of the hydraulic motor by controlling the initial rate of flow of fluid to the motor during start up.

The flow control valve of the present invention includes a poppet which is spring biased into a closed seated position and which opens against the bias of the spring as the pressure differential between the valve inlet and outlet increases. Initial downstream movement of the poppet due to this pressure differential exposes a number of bypass ports. These bypass ports are sized to permit an initial rate of fluid flow through the valve which causes the downstream motor to accelerate to a first lower motor velocity at a rate which does not exceed the acceleration limits of the flap actuating system.

Further downstream movement of the poppet uncovers a number of main inlet ports resulting in an increasing rate of fluid flow as these ports are uncovered. The acceleration of the motor from the first lower velocity to its operational velocity due to increased fluid flow as the main inlet ports are uncovered, is also accomplished in a manner not to exceed the acceleration limits of the flap system.

Movement of the poppet in the downstream direction displaces fluid from behind the poppet and through flow restrictor orifices which significantly slows the downstream movement of the poppet. Upon reduction of the inlet/outlet pressure differential at the flow control valve, such as when the flap has been repositioned to the desired location, a passageway within the flow restrictor opens to permit fluid flow in an unrestricted upstream direction against the poppet, which in cooperation with the spring biasing, causes the poppet to rapidly reset to a closed position. In the closed position the poppet serves as a check valve to prevent reverse flow toward the inlet port that can occur under certain combinations of hydraulic and mechanical system failures.

It is therefore an object of the present invention to provide apparatus and methods for limiting the rate of change of flow of a fluidized medium during start up of a hydraulic motor.

It is another object of the present invention to provide apparatus and methods for preventing a reverse flow of fluid.

BRIEF DESCRIPTION OF THE DRAWINGS

These and other objects and advantages of the present invention will become more readily apparent upon reading the following detailed description and upon reference to the attached drawings in which.

Figure 1:
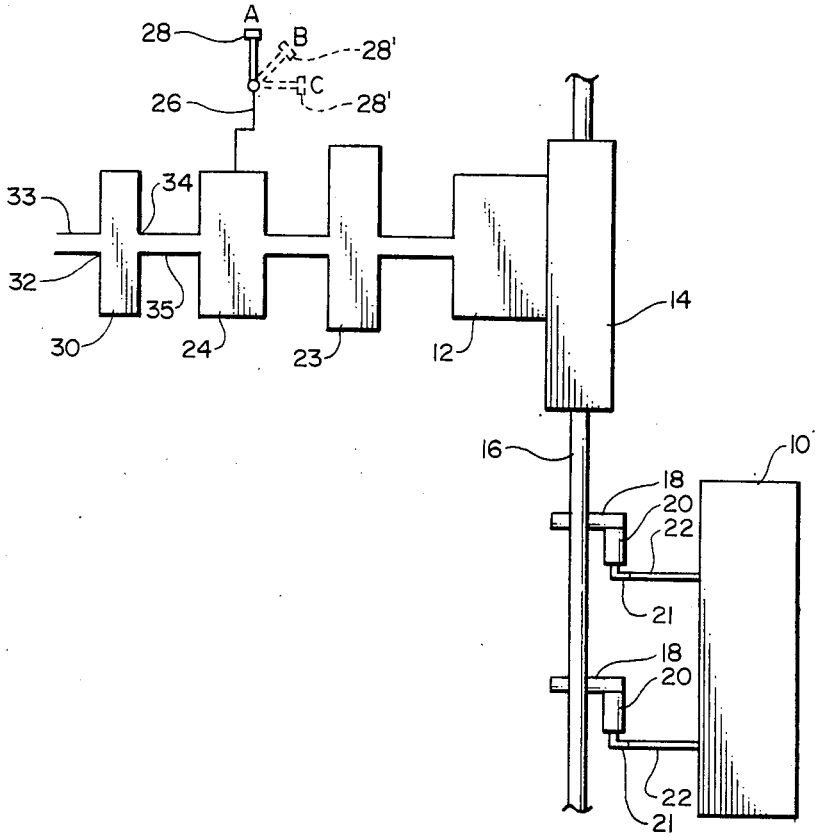
FIG. 1 is a simplified block diagram of the flap actuating system of the present invention including a control valve for limiting the rate of change of fluid to a hydraulic motor.

While the present invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention.

DETAILED DESCRIPTION

The present invention comprises a flow rate limiting valve for a hydraulic system. Although the present invention will be described in reference to a preferred embodiment wherein the hydraulic system is used to control a mechanical drive system to extend and retract a trailing edge flap, it should be appreciated that the system described herein has broader applications particularly where it is desirable to control the rate of change of fluid flow in a hydraulic system.

Referring to FIG. 1, there is shown a schematic drawing of an actuating system for a plurality of trailing edge flaps 10, only one of flaps 10 being shown in FIG. 1 for ease of illustration. The actuating system includes a number of conventional components including a hydraulic motor 12 which drives a transmission member 14 which in turn rotates a drive shaft 16. Rotational movement of drive shaft 16 is transmitted by offset gear boxes 18 to rotary actuators 20. Actuating arms 21, which are driven by rotary actuators 20, connect to flap linkage 22 to impart a fore and aft translating motion to flap 10. Located upstream of hydraulic motor 12 is a flow limiter valve 23 which is in fluid communication with motor 12 and which regulates the rate of fluid flow to motor 12 so that flap 10 is extended and retracted at a constant rate to allow the aircrew to trim out and adjust the aircraft flight attitude smoothly during movement of flap 10. Located upstream and in fluid communication with limiter valve 23 is a selector valve 24 which is in turn connected via mechanical linkage 26 to a flap control handle 28 located in the aircraft cockpit. Flap handle 28 is rotated to various detent positions by the pilot to cause fluid to be directed to motor 12 in order to reposition flap 10 in accordance with the detent position of flap handle 28. Selector valve 24 includes an outlet end in communication with limiter valve 23 and an inlet end in communication with the flow rate control valve 30 of the present invention. Flow rate control valve 30 includes an inlet end 32 for receiving pressurized fluid from the aircraft hydraulic system through an inlet conduit 33, and an outlet end 34 for discharging hydraulic fluid to the selector valve 24 through an outlet conduit 35.

In conventional flap hydraulic systems wherein flow rate control valve 30 is absent, repositioning of flap handle 28 results in a surge of pressurized hydraulic fluid to hydraulic motor 12. This is sometimes referred to as "slam-starting" the motor and it causes motor 12 to start up rapidly. In these conventional flap hydraulic systems, selector valve 24 moves from a fully closed to fully open position as flap handle 28 is repositioned. As the flap 10 approaches the position corresponding to the detent position of flap handle 28, feedback to the selector valve 24 generates a follow-up signal causing the selector valve 24 to close. Subsequent repositioning of flap handle 28 repeats the aforementioned series of events. The design constraints placed on selector valve 24 to precisely control the flaps to a number of positions commanded by the flight crew results in a valve configuration with very little modulation of flow thereby resulting in high fluid acceleration rates to motor 12. In the present invention therefore, flow rate control valve 30 is incorporated so that when flap handle 28 is repositioned, flow rate control valve 30 responds automatically and rapidly to the change in pressure differential between the inlet and outlet ends caused by repositioning of selector valve 24, to meter the flow of fluid from the upstream hydraulic system to motor 12. The initial flow of fluid is metered in a manner that the fluid flow begins at a rate which does not exceed start up acceleration limits of the torque system, e.g. torque limiters, and increases at a predetermined rate which is within these start up rate limits so as not to cause unwanted locking of the torque limiters as discussed in the Background of the Invention.

In order to understand a preferred embodiment of the present invention where flow rate control valve 30 is utilized in an aircraft flap hydraulic system to prevent unwanted locking of the rotary actuator torque limiters, a brief discussion of the torque limiters is provided. Each actuator and connecting linkage is designed to function properly when maximum predetermined airloads are applied to the flap. In the event of a failure condition that causes one or more of the actuators to jam, the jammed actuator may be exposed to the full input torque of the hydraulic motor power unit. This can result in loading forces several times greater than the maximum air loads for which the system was designed. Rather than strengthen the actuator linkage and structure in order to withstand the loads resulting from full power unit torque, it is often preferable to incorporate an input torque limiting brake in the actuator. These torque limiters are designed to sense the input torque, and at loads in excess of a maximum design airloads, to actuate a brake that engages the input drive, thereby preventing the input drive force from being transmitted to the downstream output drive, and thus preventing movement of the rotary actuator gearing and flap linkage. Experience has shown that the torque limiters can cause unwanted lockup if subject to very rapid input acceleration. The rapid acceleration is opposed by the inertial loads and drag loads due to viscous grease as discussed in the Background of the Invention. At higher altitudes and cold temperatures this grease is especially viscous. Thus, the rapid start up of the shaft 16 coupled with these inertial and drag loads, results in the actuation of the torque limiters and an unwanted lockup condition.

Figure 2:
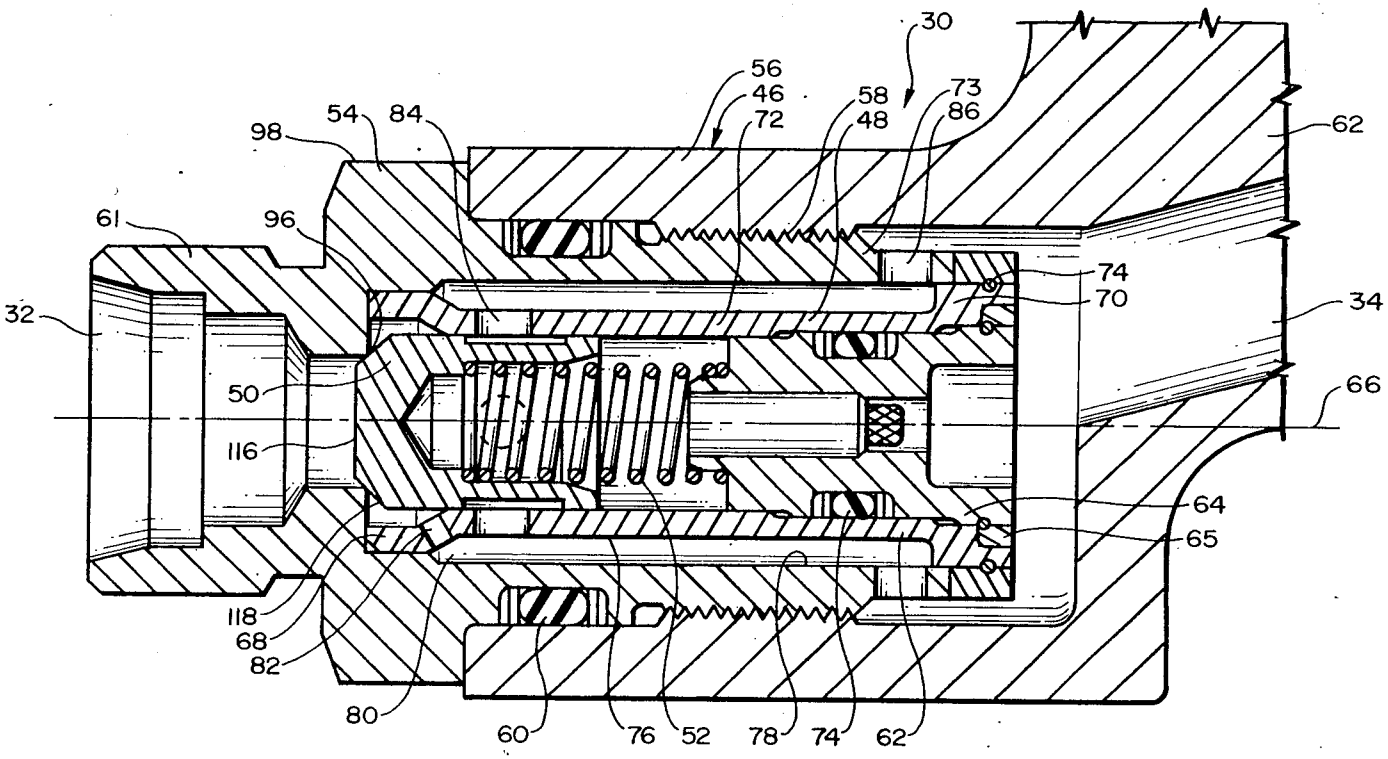
FIG. 2 is a side sectional view of the control valve showing a flow restricting poppet in a first "fully closed" position.

To provide a better understanding of the present invention, the principal elements of flow control valve 30 and their operation will be discussed first with reference to FIG. 2, followed by more detailed discussion of the aforementioned principal elements and those remaining elements of the invention. Flow rate control valve 30 includes the following main components: a main housing indicated at 46, a sleeve assembly 48 fixedly mounted in the housing 46, a movable valve element or poppet 50 movably mounted in the sleeve assembly 48, and a biasing spring 52 which urges the poppet 50 toward its closed position.

The housing 46 comprises right and left housing sections 54 and 56 which are joined together at a threaded connection 58. Specifically, the right housing section 56 is formed with interior threads which engage the exterior threads of the left housing section 54. A circumferential seal 60 is provided between the upstream end of the housing section 56 and the left housing section 54. The housing section 54 has a left end portion 61 that defines the aforementioned inlet opening 32, and the extreme right end of the housing section 56 has an end portion 62 that defines the aforementioned outlet opening 34.

The aforementioned sleeve assembly 48 comprises a generally cylindrical sleeve member 62 and an end closure member 64 mounted in the right end portion of the sleeve member 62 and retained by a shear wire 65. The center axis of the cylinder defined by the sleeve member 62 shall, for purposes of description, be considered the longitudinal center axis of the valve 30, this longitudinal axis being designated 66. The term "inner" shall denote proximity to the longitudinal axis 66, while the term "outer" shall denote a radial location further from the axis 66.

The sleeve member 62 can be considered as having extreme left and right end portions 68 and 70, and a middle portion 72. The left end portion 68 fits snugly within the left housing portion 54 at a location just to the right of the inlet portion 61. The right end portion 70 fits within the extreme right end portion 73 of the left housing section 54 and is retained by a shear wire 74. The middle portion 72 of the sleeve member 62 has an outside diameter moderately smaller than the sleeve end portions 68 and 70, and the outer cylindrical surface 76 of the middle sleeve portion 72 forms with the inwardly facing cylindrical surface 78 of the housing section 54 an annular fluid passageway 80.

Formed in the left portion of the sleeve member 62 are a first set of bypass ports 82, and a second set of main ports 84, which lead into the upstream end of the passageway 80. The arrangement and operation of these ports 82 and 84 are important in the operation of the present invention, and these will be described in more detail later herein. The right end of the housing section 54 is formed with a set of outlet ports 86 which lead from the aforementioned passageway 80. These passageways 86 are conviently formed as circular openings spaced circumferentially around the right end of the housing section 54.

Referring to FIGS. 2 through 6 in more detail, left housing section 54 (FIG. 3) includes inlet 32 which is formed by an axially extending inner surface 92 which joins downstream with an outwardly extending surface 94. An annular seat 96 for receiving movable poppet 50 thereagainst in a fluid tight fit is defined by the intersection of surfaces 92, 94. Inner surface 94 extends outwardly to a corner 95 which joins with an inner cylindrical surface extending axially downstream to define an axial bore 97.

To obtain proper seating of poppet 50 against seat 96, poppet 50 includes a frustoconically shaped nose portion including a forward surface 116 which is integrally joined to an angled surface 118 extending downstream and outwardly from forward surface 116. A side surface 120 extends axially downstream from angled surface 118 and terminates at an end surface 122. When poppet 50 is in the closed position illustrated in FIG. 2, front surface 116 extends axially within inlet portion 32, and angled surface 118 engages annular seat 96 in a fluid tight fit.

In order to regulate the flow of fluids from inlet 32 through passageway 80 (FIG. 3) to outlet ports 86, poppet valve 50 is slidably engaged within sleeve 62 for axial movement along an inner surface 123 of middle portion 72. Cylindrical sleeve 62 is axially rigidly engaged within axial bore 97 by shear wire 74 and abuts corner 95 in a fluid tight fit. In order to form an annular inlet to bypass ports 82, sleeve wire 74 end portion 68 includes a radially flared inlet portion 126 which extends downstream to an inwardly angled portion 128, which in turn joins with downstream extending middle portion 72. Inlet portion 126 includes an axially extending inner surface 130 which has a diameter greater than the diameter of seat 96, and which meets an inwardly angled surface 132 of angled portion 128. Inner surfaces 130, 132 form an annular inlet 134 in fluid communication with inlet 32 when poppet is in an unseated position shown in FIGS. 4 through 6. Angled portion 128 of sleeve 62 includes a plurality of annularly located bypass ports 82 which fluidly communicate inlet 32 with downstream extending annular passageway 80. A path is provided for the flow of fluids from inlet end 32 via passageway 80 and outlet ports 86 to outlet 34.

Figure 7:
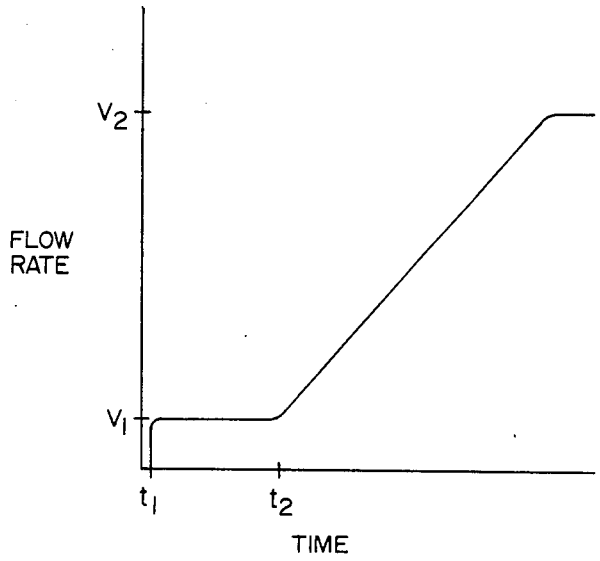
FIG. 7 is an illustration of flow rate as a function of time when using the control valve of the present invention.

When poppet 50 is initially unseated, an annular opening (FIG. 3) is formed between poppet 50 and seat 96 which allows annular inlet 134 to be filled. The cross-sectional area of this opening is greater than the combined cross-sectional area of bypass ports 82. Thus, the rate of fluid flow into inlet 134 is greater than the discharge of fluid from bypass ports 82 into passageway 80. This permits a maximum rate $V_1$ of fluid flow through bypass ports 82 at time $t_1$ in FIG. 7, which occurs almost immediately as poppet 50 is unseated. This maximum fluid flow through bypass ports 82 upon initial unseating of poppet 50 is independent of the further downstream movement of poppet 50. However, bypass ports 82 are sized in their cross-sectional area to limit the fluid flow therethrough so that motor 12 accelerates from a stationary state to a first lower speed, without exceeding the torque limits of the flap system. Preferably the change in speed of motor 12 from the stationary state to the first speed is much less than the change in speed of motor 12 from the first speed to its operational speed.

With flow established through bypass port 82 at a constant rate $V_1$, uncovering of main inlet ports 84 is delayed by a time $\Delta t = t_2 - t_1$ to insure that the rotary actuator and linkage assembly have moved a sufficient amount from the stationary state to take up any slack between these interacting components, and to insure that (i) the inertial forces which act to restrain the components at rest, and (ii) the drag forces, e.g. viscous grease in the rotary actuator, have been overcome. During time $\Delta t$, the fluid flow rate is generally constant. However, as the poppet 50 continues to move rightward and main inlet ports 84 begin to be uncovered at time $t_2$, the flow rate increases to a maximum rate $V_2$ and motor 12 accelerates from the first lower velocity to its operational velocity as a result of a modulated uncovering of inlet ports 84 which will be described further hereinafter.

To bias poppet 50 in a direction towards seat 96, poppet 50 includes an inner U-shaped recess 148 (FIG. 3) for engaging annularly extending helical spring 52. The inner recess 148 of poppet 50 is formed by a conical upstream position having sidewalls which extend axially and then outwardly to define an lip 152 for engaging a forward end of spring 52, and then extend further downstream to define a radial diameter equivalent to the outer radial diameter of spring 52 to support spring 52 securely within recess 148. Spring 52 is supported at its opposite end about an upstream extending nose portion 153 of end closure member 64.

The rate of movement of poppet 50 in the rightward direction is limited by a conventional flow restrictor 160 (FIG. 4), such as a type manufactured by Lee Company of California, and which is rigidly engaged within a passageway extending axially within end closure 64. An upstream end of flow restrictor 160 is in communication with a chamber 162 formed by inner surface 123 of sleeve middle portion 72 and recess 148 of poppet 50; whereas a downstream end of flow restrictor 160 is in fluid communication with outlet 34. End closure 64 includes an annular slot which houses a sealing ring 166 in sealing engagement with end closure 64 and inner surface 123 of sleeve 62.

Flow restrictor 160 includes an outer cylindrical casing which houses a plurality of axially extending flow restriction passageways 170 (FIG. 4) which limit the rate of flow of fluid between chamber 162 and outlet 34. Therefore as poppet 50 moves in a rightward downstream direction due to a pressure differential between inlet 32 and outlet 34, fluid disposed within chamber 162 is displaced downstream through restriction passageway 170 to outlet 34 thereby limiting the rate of movement of poppet 50 in the rightward direction.

Figure 3:
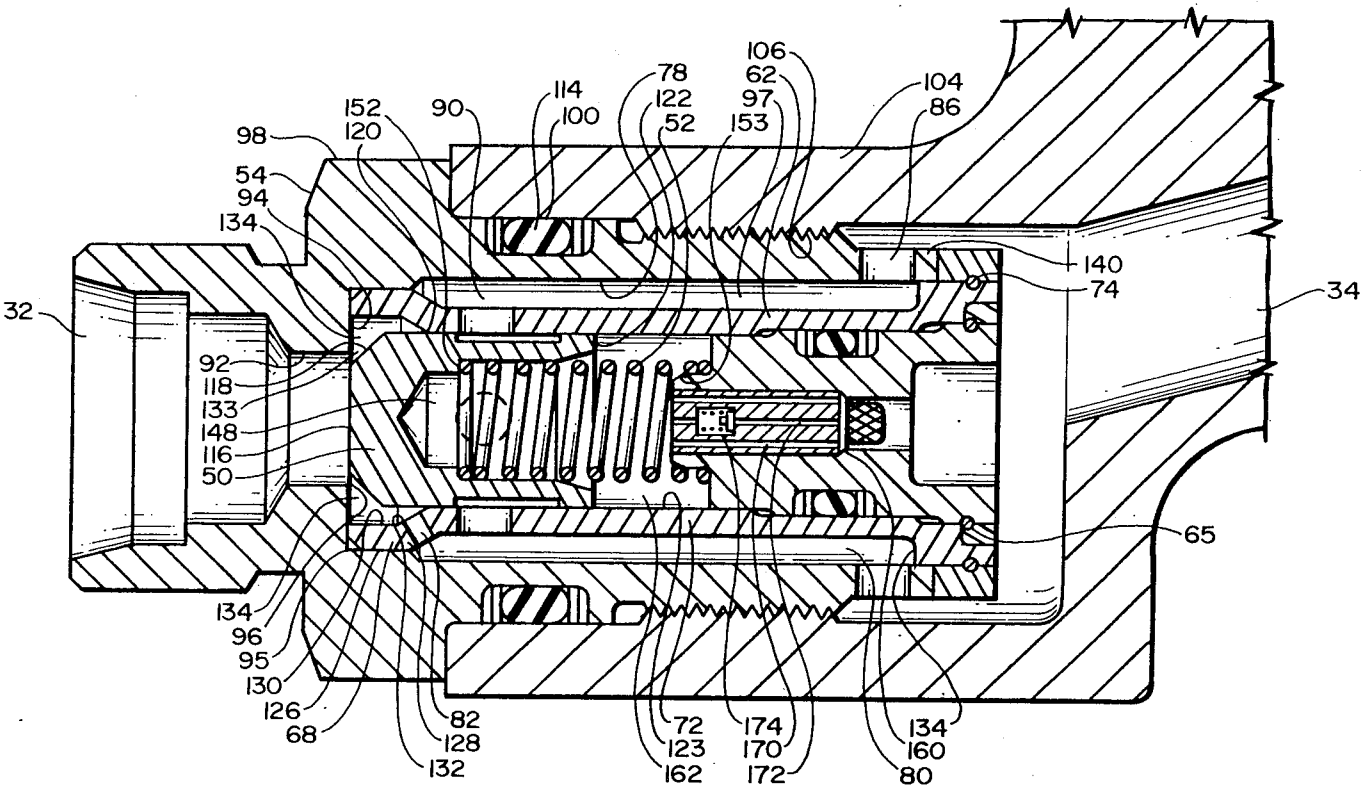
FIG. 3 is a side sectional view of the control valve taken along the same section as in FIG. 2, and showing the valve in a second position where the flow control poppet is at a location downstream of the fully closed position shown in FIG. 2 to uncover bypass ports for allowing a small predetermined rate of fluid flow between inlet and outlet ends of the valve.

Poppet 50 is biased by spring 52 in a leftward upstream direction, in a manner that as the pressure of fluid entering inlet 32 increases, the biasing force of spring 52 is overcome causing poppet 50 to move in a rightward direction away from seat 96 to a location shown in FIG. 3, thereby exposing bypass ports 82 to the incoming fluid from inlet 32. The rate of movement of poppet 50 is limited by the fluid in chamber 162 which must be displaced through the restrictor 160. As the fluid in chamber 162 is displaced through restriction passageways 170, poppet 50 continues to move rightward along sleeve inner surface 123 to a location shown in FIG. 4 thereby uncovering a portion of main inlet ports 84. Main inlet ports 84 extend outwardly between surfaces 76, 123 of sleeve middle portion 72 downstream of angled portion 128, and are disposed annularly about sleeve 62. Main inlet ports 84 fluidly communicate with passageway 80 at an upstream end of sleeve middle portion 72.

Figure 4:
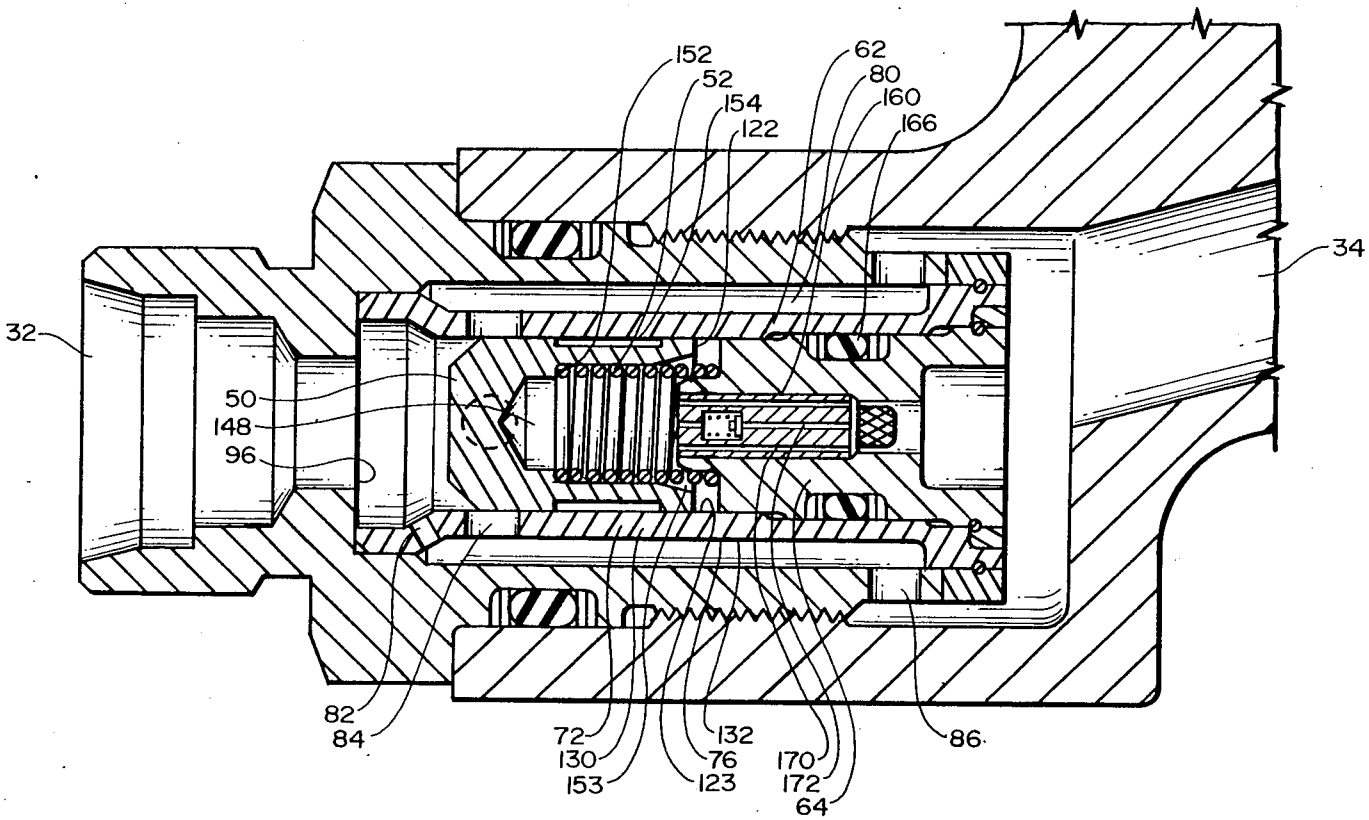
FIG. 4 is a side sectional view of the control valve taken along the same section as in FIG. 2 showing the valve in a third position where the flow control poppet is at a location downstream of the location shown in FIG. 3 and where main inlet ports are partially uncovered.
Figure 5:
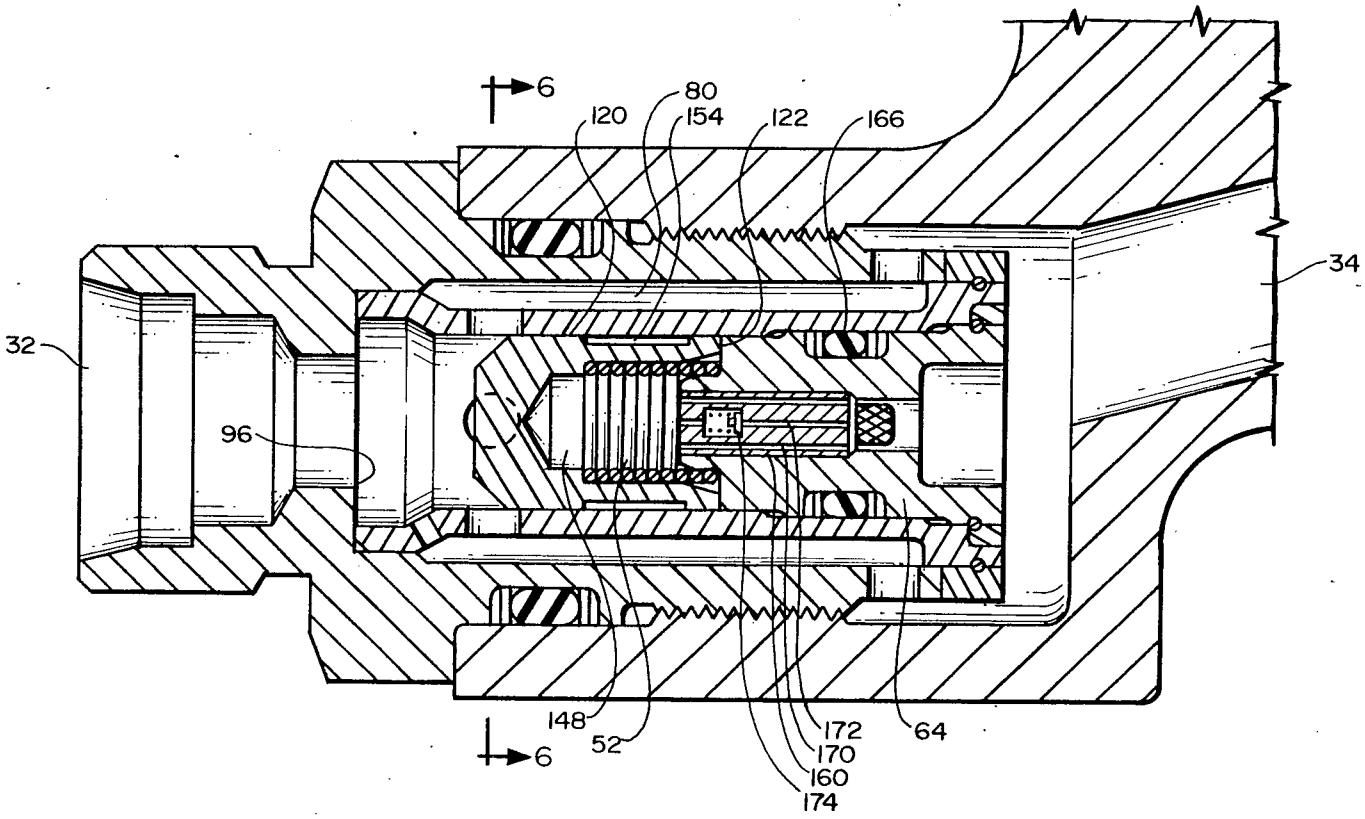
FIG. 5 is a side sectional view of the control valve taken along the same section as in FIG. 2 showing the valve in a fourth position where the flow control poppet is at a location downstream of the location shown in FIG.4 where the main inlet ports are fully uncovered in order to deliver maximum flow of fluid between the inlet and outlet of the valve.
Figure 6:
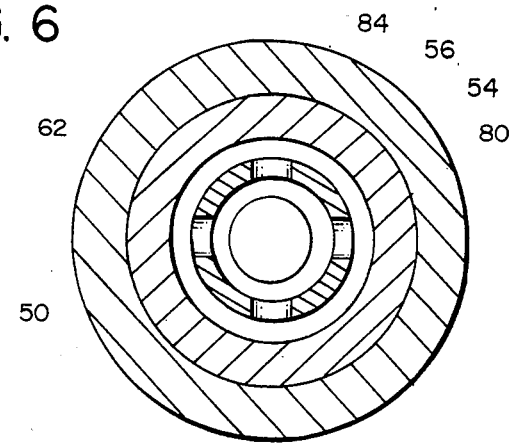
FIG. 6 is an end sectional view of the control valve taken along line 6—6 of FIG. 5.

Movement of poppet 50 to the partially open location shown in FIG. 4 allows incoming fluid at inlet 32 to communicate with annular passageway 80 and to be discharged downstream through outlet ports 86 and outlet 34. As the fluid in chamber 162 is released through restrictor 160, poppet 50 is displaced further downstream until poppet end surface 122 abuts the upstream surface of end closure member 64, as shown in FIG. 5, thereby further uncovering main inlet ports 84 to permit a maximum amount of fluid flow between inlet 32 and outlet 34. Poppet 50 includes an annular recess 154 located along poppet side surface 120 to provide a hydraulic balance between fluid in passageway 80 (FIG. 3) and fluid in poppet recess 148 thereby preventing poppet 50 from binding within sleeve 62.

Referring to FIGS. 1 and 5, when flap 10 is repositioned to the desired location in accordance with the detent position of flap handle 28, selector valve 24 closes, and motor 12 decelerates and then stops. The pressure differential between inlet 32 and outlet 34 of flow control valve 30 rapidly decreases, and the biasing effect of spring 52 causes poppet 50 to rapidly move in a leftward closing direction against seat 96 in preparation for subsequent repositioning of flap handle 28 and another start up of hydraulic motor 12. To permit flow of fluid in an upstream direction from outlet 34 to chamber 162, flow restrictor 160 includes a passageway 172 (shown schematically) which includes a spring biased one-way check valve 174 (also shown schematically) in a manner that a higher pressure at outlet 34 than in chamber 162 causes the check valve 174 to open to permit upstream fluid flow through passageway 172. On the other hand, a higher pressure in chamber 162 than at outlet 34, such as when selector valve 24 has been opened in response to a command from flap control handle 28, causes check valve 174 to close thereby blocking passageway 172 and directing fluid in a downstream direction through the restriction passageways 170.

By moving to a closed position against seat 96 when the pressure differential between an inlet and outlet decreases sufficiently, poppet 50 operates as a check valve to prevent unwanted reverse flow of fluid in the event of a failure condition in which motor 12 is back driven. This failure condition may result when there is a loss of hydraulic pressure, and mechanical means within the rotary actuator for preventing flap loads from back driving the system have failed. If unchecked, the aerodynamic forces acting on the flap cause movement of the mechanical components of the flap and reverse flow of fluid in the system. In the present invention, the seated poppet 50 prevents this backflow of fluid and causes the flaps to remain at their last commanded position.

What is claimed is:

1. A control valve for controlling a rate of change of fluid flow from a fluid source to hydraulic motor means to prevent the motor means from exceeding a maximum acceleration rate during start up, said control valve comprising:

a. a valve body having an inlet in communication with said fluid source, an outlet in communication with said motor means, and first and second passageways in communication with said outlet;

b. flow limiting means including a flow control member biased in a manner to restrict the flow of fluid to said outlet through said first and second passageways, said flow control member movable in a first direction against said bias in response to a pressure differential between said inlet and said outlet to communicate said inlet with said first passageway in a manner to allow a predetermined rate of fluid flow through said first passageway which causes said motor means to accelerate to a first speed at a rate which does not exceed said maximum start up acceleration rate; and c. said flow control member being movable further in said first direction at a controlled rate in response to an increase in said pressure differential to communicate said inlet with said second passageway after said motor means has accelerated to said first speed, in a manner that a rate of fluid flow from said inlet through said second passageway to said outlet increases in response to said further movement of said flow control member in said first direction to cause said motor means to accelerate from said first speed to a second speed at a rate which does not exceed said maximum start up rate.

2. The control valve as set forth in claim 1 wherein:

a. said motor means is caused to accelerate to said first speed prior to said communication of said inlet with said second passageway by establishing a predetermined rate of flow of fluid to said motor means through said first passageway during an initial movement of said flow control member in said first direction; and b. said predetermined rate of fluid flow during said initial movement causes said motor means to accelerate from a substantially stationary state to said first speed prior to said communication of said second passageway with said inlet so that inertial forces of said motor means at said stationary state are overcome before said motor means accelerates to said second speed.

3. The control valve as set forth in claim 2 wherein:

a. said first passageway is sized in a manner to deliver said fluid to said motor means at said predetermined rate; and b. said initial movement of said flow control member permits a flow of fluid to said first passageway at a rate which is at least equivalent to said predetermined rate.

4. The flow control member as set forth in claim 3 wherein:

a. said first passageway is sized to have a first cross sectional area which delivers said fluid to said motor means at said predetermined rate; and b. said initial movement of said flow control member communicates said inlet with said first cross sectional area of said first passageway.

5. The flow control member as set forth in claim 4 wherein said initial movement of said flow control member generates an opening in communication with said first passageway and said inlet to permit said flow of fluid to said first passageway at said rate which is at least equivalent to said predetermined rate.

6. The control valve as set forth in claim 2 wherein said increasing rate of flow through said second passageway is achieved by uncovering a greater portion of said second passageway by said further movement of said flow control member in said first direction.

7. The control valve as set forth in claim 2 wherein:

a. said inlet includes an upstream portion adapted to engage said flow control member in a fluid tight fit to restrict said movement of said fluid to said first and second passageways, and a downstream portion in communication with said first passageway and spaced apart from said flow control member at a predetermined distance to define a fluid inlet chamber which is in communication with said first passageway; and b. said initial movement of said flow control member in said first direction in response to said pressure differential displaces said flow control member from said inlet upstream portion to define an opening in communication with said fluid inlet chamber to permit said flow of fluid to said first passageway at said rate which is at least equivalent to said predetermined rate.

8. The control valve as set forth in claim 1 wherein:

a. said flow control member is movably engaged within a cavity in said valve body;

b. said valve body includes fluid discharge means for restrictively conducting fluid from said cavity to said outlet in a manner to control the rate of said movement of said flow control member in said second direction.

9. The flow control valve as set forth in claim 8 wherein said flow discharge means includes at least one passageway, in fluid communication with said cavity and said outlet, and which is sized to restrict the discharge of fluid from said cavity so as to limit the rate of movement of said flow control member in said second direction.

10. The flow control valve as set forth in claim 9 wherein:

a. said biasing means comprise spring means which extend axially within said cavity between said flow control member and said valve body so that movement of said flow control member in said second direction compresses said spring means between said flow control member and said valve body; and b. said biasing means causes said flow control member to move in said first direction in response to a reduction in said pressure differential.

11. An airfoil actuating system for an aircraft comprising:

a. actuator means for moving airfoil means in response to a drive force input, said actuator means including limiting means for preventing said actuator means from moving said airfoil means when said drive force exceeds a predetermined force level;

b. drive means, responsive to a fluid flow, for generating said drive force input to move said airfoil means;

c. means for generating said fluid flow; and d. flow regulating means including first means for regulating said flow from a state of substantially no fluid flow, where said drive means is in a stationary state and subject to inertial and viscous drag forces, to a first flow rate to cause said drive means to accelerate from said stationary state to a first speed to escape said inertial and drag forces in a manner to generate a first drive force which is not in excess of said predetermined force level, and second means for regulating said fluid flow to said drive means so that said drive means accelerates from said first speed to a second speed in a manner to generate a second drive force which is not in excess of said predetermined drive force.

12. The actuating system as set forth in claim 11 wherein:

a. said drive means includes fluid motor means which are operatively connected to said actuator means to generate said drive force for moving said airfoil; and b. said flow regulating means regulates said drive force input to said drive means by limiting a rate of fluid flow to said motor means.

13. The actuating system as set forth in claim 12 wherein:

a. said flow regulating means includes (i) a valve body having a cavity portion with an inlet in communication with said generating means and an outlet in communication with said drive means and (ii) a flow control member movably engaged within said cavity and biased in a first direction toward said inlet to restrict said flow of fluid to said motor means; and b. said flow control member is movable in a first direction against said bias in response to a pressure differential between said inlet and said outlet in a manner to permit a fluid flow rate which causes said motor means to accelerate in a manner that said first drive force does not exceed said predetermined force level.

14. The actuating system as set forth in claim 12 wherein said flow control member is biased in said first direction in a manner that in response to a reduction in said pressure differential said flow control member closes said inlet to prevent reverse flow of fluid from said drive means to said generating means in the event of aerodynamic forces acting upon said airfoil means which exert a back driving force on said actuator means.

15. The actuating system as set forth in claim 13 wherein said flow regulating means includes:

a. a valve body having an inlet in communication with said generating means, an outlet in communication with said drive means, a first portion located downstream of said inlet, a second position located downstream of said first portion, a first passageway in communication with said first portion and said outlet, and a second passageway in communication with said second portion and said outlet;

b. a flow control member biased toward said inlet in a manner to restrict a rate of flow of fluid from said inlet to said first and second passageways, said flow control member movable in a first direction against said bias in response to a pressure differential between said inlet and said outlet to communicate said inlet with said first portion in a manner to allow a rate of fluid flow through said first passageway which causes said drive means to accelerate to a first speed at a rate such that said first drive force input does not exceed said predetermined force level; and c. said flow control member is movable further in said first direction at a controlled rate in response to an increase in said pressure differential to communicate said inlet with said second portion in a manner to permit a rate of fluid flow from said inlet through said second passageway to said outlet which increases in response to said further movement of said flow control member in said first direction to cause said drive means to accelerate at a rate such that said second drive force input does not exceed said predetermined force level.

16. A method for regulating a rate of fluid flow from a fluid source to a hydraulic motor so as to regulate the start up acceleration rate of the motor from a stationary state, where the motor is subject to inertial and viscous drag forces, to a selected operational speed, the method comprising the steps of:

a. providing (i) a first conduit in communication with the fluid source and the motor, and (ii) a second conduit in communication with the fluid source and the motor;

b. biasing a flow control member in a first direction to restrict a flow of fluid through the first and second passageways;

c. moving the flow control member an initial amount in a second direction in opposition to the bias direction in response to a pressure differential to allow predetermined rate of fluid flow through the first passageway to cause the motor to accelerate to a first lower speed where the inertial and drag forces have been substantially reduced, at a rate which does not exceed a maximum acceleration rate; and d. moving the flow control member at a controlled rate after the motor has reached the first speed, further in the first direction in response to an increasing fluid force to allow a flow through the second passageway in a manner that the rate of flow progressively increases in response to the movement of the flow control member in the first direction to cause the motor to accelerate from the first speed to the operational speed at a rate which does not exceed the maximum acceleration rate.

17. The method as set forth in claim 16 wherein the rate of fluid flow is achieved upon an initial movement of the flow control member in the first direction to cause the motor to accelerate to the first speed prior to the flow of fluid through the second passageway.

* * * * *